US006536558B2

(12) United States Patent
Price

(10) Patent No.: US 6,536,558 B2
(45) Date of Patent: Mar. 25, 2003

(54) FOLDING LADDER

(76) Inventor: Harold E. Price, 335 Prospectdale Rd., Pearisburg, VA (US) 24134-2629

( * ) Notice: Subject to any disclaimer, the term of this patent is extended or adjusted under 35 U.S.C. 154(b) by 0 days.

(21) Appl. No.: 09/783,962

(22) Filed: Feb. 16, 2001

(65) Prior Publication Data

US 2002/0112920 A1 Aug. 22, 2002

(51) Int. Cl.[7] ..... E06C 1/00
(52) U.S. Cl. ..... 182/162; 182/160
(58) Field of Search ..... 182/96, 159, 162, 182/160, 25; 16/366, 371, 374

(56) References Cited

U.S. PATENT DOCUMENTS

| | | | | | |
|---|---|---|---|---|---|
| 341,284 | A | * | 5/1886 | Sharp | 182/25 |
| 350,047 | A | | 9/1886 | Dunn | |
| 1,557,490 | A | * | 10/1925 | Videtta | 182/160 X |
| 1,606,445 | A | * | 11/1926 | Pirsch | 182/159 |
| 2,088,878 | A | * | 8/1937 | Stogner | 182/162 |
| 2,875,935 | A | | 3/1959 | Buttermore et al. | |
| 3,439,776 | A | | 4/1969 | Scheerer | |
| 3,722,622 | A | | 3/1973 | Lauring | |
| 3,756,347 | A | | 9/1973 | Messera et al. | |
| 3,946,833 | A | * | 3/1976 | Riehlmann | 182/195 X |
| 4,243,119 | A | * | 1/1981 | Rossey, Sr. | 182/96 |
| 4,428,458 | A | * | 1/1984 | Fiore et al. | 182/162 X |
| 4,463,829 | A | | 8/1984 | Grin | |
| 4,678,060 | A | | 7/1987 | Pugliese | |
| 4,842,099 | A | | 6/1989 | Collet et al. | |
| 4,998,599 | A | | 3/1991 | Wang | |
| 5,158,151 | A | | 10/1992 | Chang | |
| 5,195,610 | A | | 3/1993 | Chang | |
| 5,339,920 | A | | 8/1994 | Eriksson | |
| 5,353,892 | A | | 10/1994 | Lu | |
| 5,788,011 | A | | 8/1998 | Kemmer et al. | |
| 5,944,141 | A | | 8/1999 | Kochan et al. | |
| 6,145,621 | A | * | 11/2000 | Nye | 182/159 |

* cited by examiner

*Primary Examiner*—Daniel P. Stodola
*Assistant Examiner*—Hugh B. Thompson
(74) *Attorney, Agent, or Firm*—Burns, Doane, Swecker & Mathis, LLP

(57) ABSTRACT

A folding ladder includes a first side rail and a second side rail, and at least one rung pivotally attached at its ends to the first and second side rails. The ladder further includes at least one diagonal locking member having a first portion pivotally attached at a first end to the first side rail and a second portion pivotally attached at a first end to a second end of the first portion and a second end pivotally attached to the second side rail. The locking member locks the folding ladder in a use position.

19 Claims, 10 Drawing Sheets

FOLDING LADDER

The present invention relates to a folding ladder and, more particularly, to a ladder that is laterally foldable.

Conventional straight ladders and step ladders have left and right side rails and one or more, usually a plurality, of rungs rigidly attached between the side rails. Such conventional ladders occupy a substantial amount of space due to the large open spaces between the rungs and the rails.

Step ladders typically include legs that are pivotally attached to top ends of the side rails so that, when the step ladder is not in use, the legs can be folded to a position in which they are substantially adjacent to and parallel with the side rails. However, the step ladder still occupies a substantial amount of space due to the large open spaces between the rungs and the rails.

Various attempts have been made to provide a ladder that can be laterally folded so that the rungs are substantially parallel to the legs and, when the ladder is not in use, it does not occupy as much space as when in use. U.S. Pat. No. 4,463,829, for example, discloses a foldable ladder having an arrangement of parallel rails with pivotally connected rungs. A ladder of this type can be folded to a dimension that is a fraction of that of the ladder in the unfolded condition.

One drawback to the use of foldable ladders is that they tend to be lacking in stability. It is, therefore, desirable to provide a foldable ladder that is highly stable when in an open condition.

According to one aspect of the present invention, a folding ladder includes a first side rail and a second side rail, and at least one rung having a first end portion and a second end portion, the first end portion being pivotally attached to the first side rail and the second end portion being pivotally attached to the second side rail, the rung being pivotable relative to the first side rail and the second side rail between a use position in which the rung is substantially perpendicular to each of the first side rail and the second side rail and a closed position in which the rung is substantially parallel to each of the first side rail and the second side rail. The ladder further includes at least one diagonal locking member having a first portion pivotally attached at a first end to the first side rail and a second portion pivotally attached at a first end to a second end of the first portion and a second end pivotally attached to the second side rail, the first portion and the second portion being in a substantially parallel closed position when the rung is in the closed position and being pivotable relative to each other to a locking position in which the first portion and the second portion are substantially parallel to each other and non-perpendicular to the first side rail and the second side rail when the rung is in the use position, the locking member including a stop disposed on at least one of the first portion and the second portion for preventing the first portion and the second portion from pivoting relative to each other beyond the locking position.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
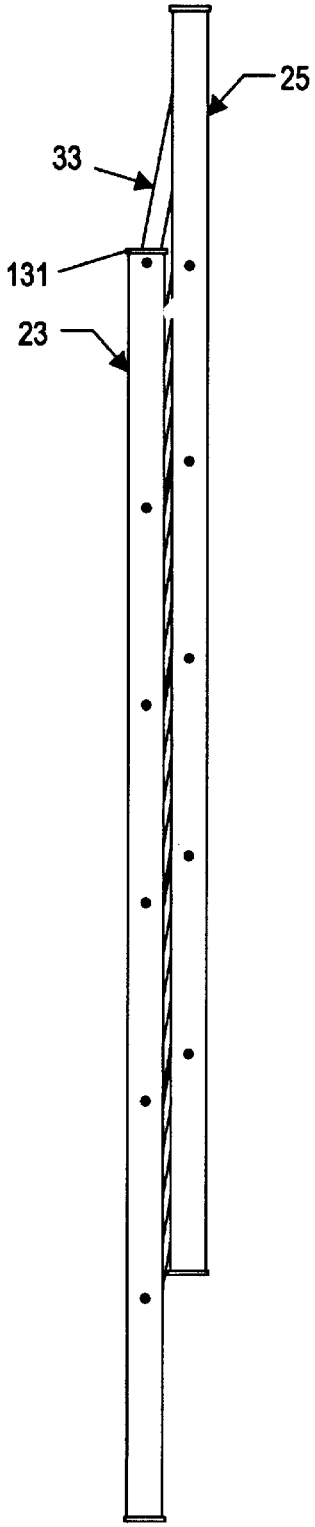
FIGS. 1A, 1B, and 1C are front views of a foldable ladder according to an first embodiment of the present invention showing the ladder in a closed position, an intermediate position, and a use position, respectively.
Figure 1B:
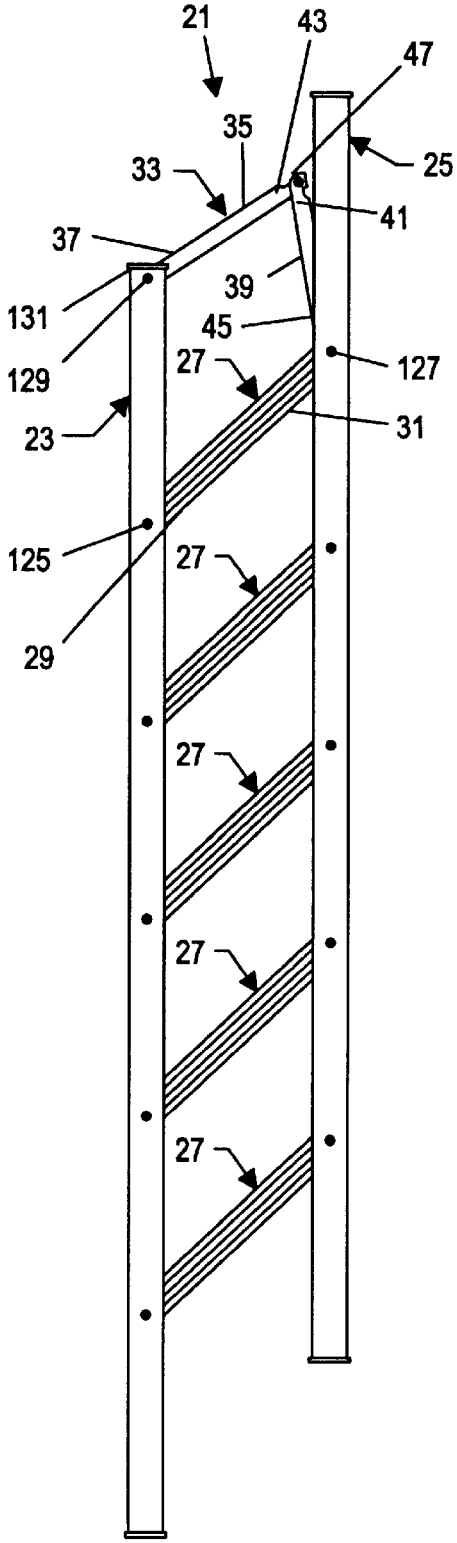
Figure 1C:
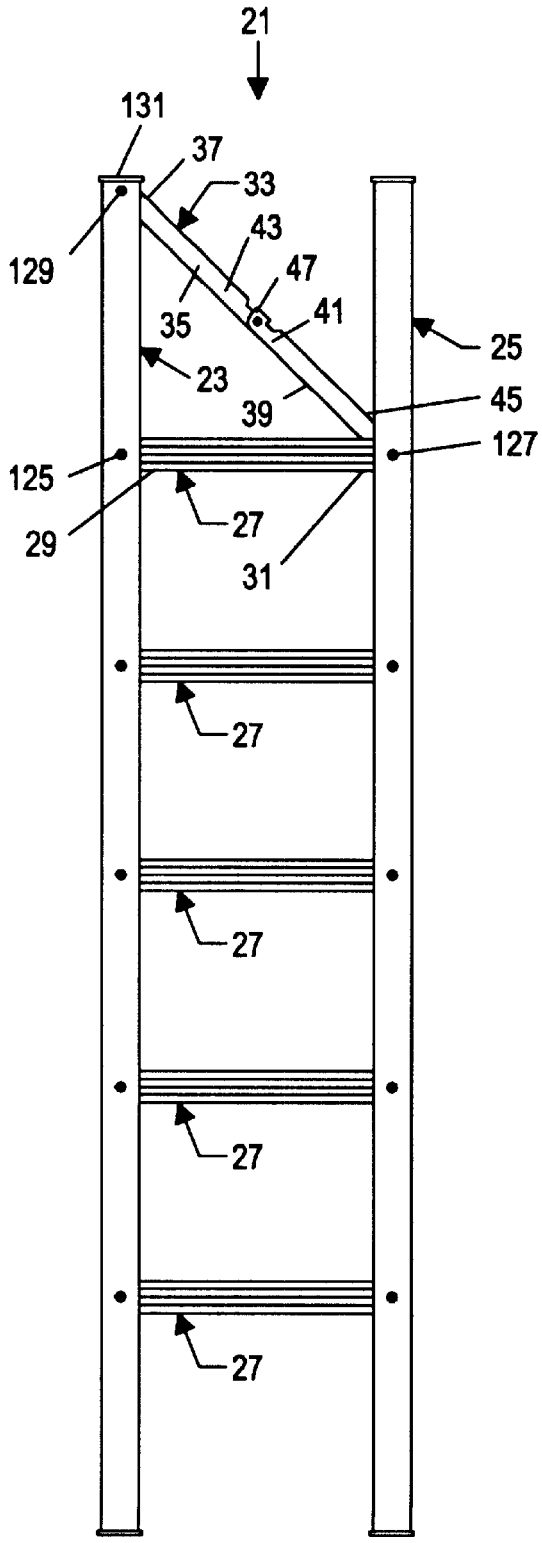

A folding ladder 21 according to an embodiment of the present invention is shown in FIGS. 1A–3A. The ladder 21 includes a first side rail 23 and a second side rail 25. The ladder also includes at least one rung 27, preferably a plurality of rungs. Each rung 27 has a first end portion 29 and a second end portion 31. The first end portion 29 is pivotally attached to the first side rail 23 and the second end portion 31 is pivotally attached to the second side rail 25. The rung 27 is pivotable relative to the first side rail 23 and the second side rail 25 between a use position (FIG. 1C) in which the rung is substantially perpendicular to each of the first side rail and the second side rail and a closed position (FIG. 1A) in which the rung is substantially parallel to each of the first side rail and the second side rail.

Figure 2:
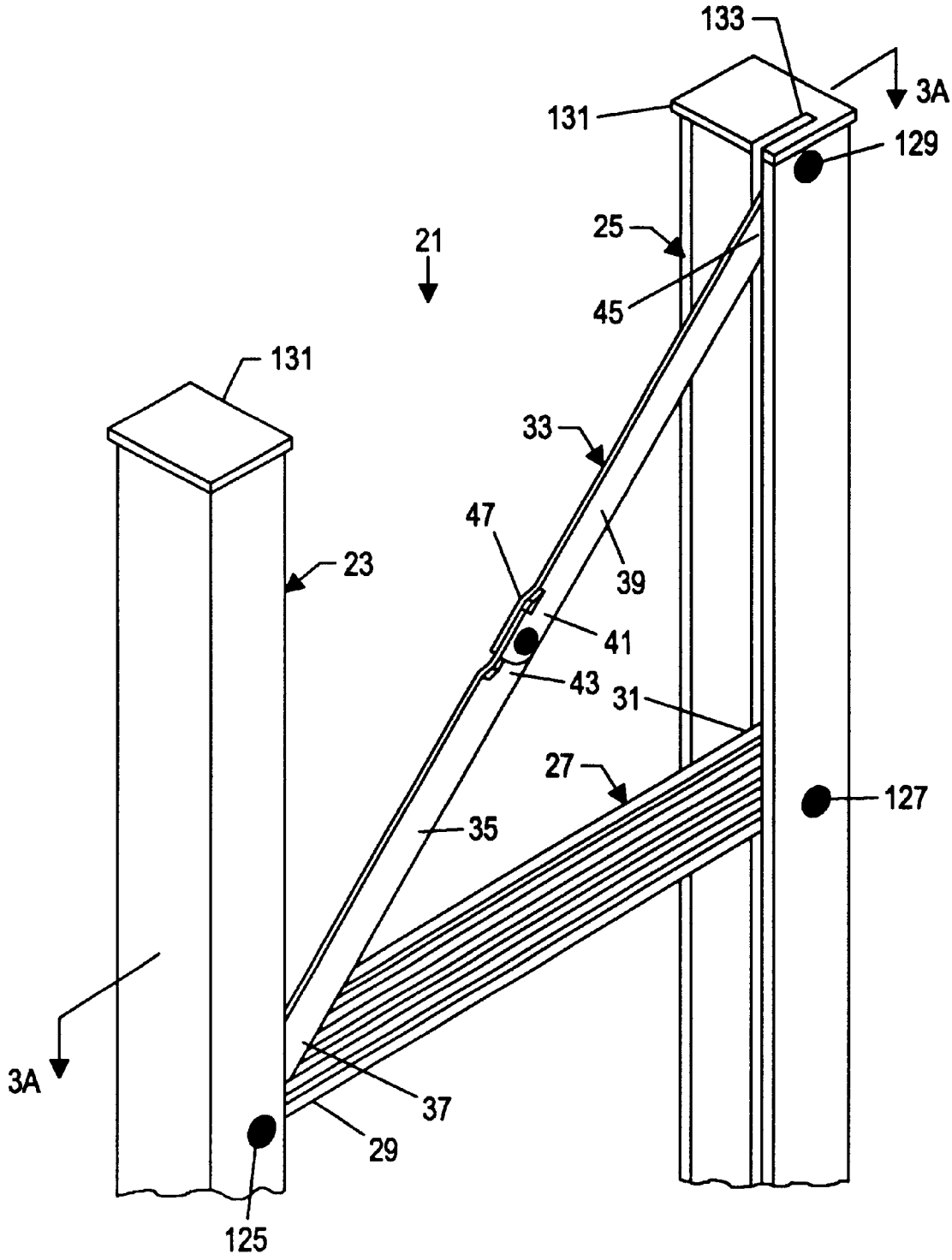
FIG. 2 is a perspective view of a portion of a foldable ladder according to the first embodiment of the present invention.

As seen in FIG. 2, the ladder 21 also includes at least one diagonal locking member 33 having a first portion 35 pivotally attached at a first end 37 to the first side rail 23 and a second portion 39 pivotally attached at a first end 41 to a second end 43 of the first portion 35 and a second end 45 pivotally attached to the second side rail 25. The first portion 35 and the second portion 39 are in a substantially parallel closed position when the rung 27 is in the closed position (FIG. 1A) and are pivotable relative to each other to a locking position (FIGS. 1C and 2) in which the first portion and the second portion are substantially parallel to each other and non-perpendicular to the first side rail 23 and the second side rail 25 when the rung is in the use position. The locking member 33 includes a stop 47 disposed on at least one of the first portion 35 and the second portion 39 for preventing the first portion and the second portion from pivoting relative to each other beyond the locking position.

The stop 47 may be in any suitable form, such as a bent or attached portion on the first portion 35 and/or the second portion 39, or a separate member such as a U-shaped member having legs between which each of the first portion 35 and the second portion 39 are pinned. Various stops suitable for use in connection with the present invention are frequently used on conventional step ladders and need not be discussed further here. The stop 47 preferably permits the first portion 35 and the second portion 39 to pivot relative to each other slightly past the point at which the first and the second portion are perfectly parallel to each other. In this way, when the ladder 21 is in the use position, when the ladder is under load the first portion and the second portion will be urged to pivot further past the point at which they are stopped by the stop, as opposed to back to a closed position.

The embodiment of the ladder 21 shown in FIGS. 1A–3A is a straight ladder. However, the structures described above are equally applicable to other types of ladders, such as step ladders. A step ladder 121 according to a second embodiment of the present invention is shown in FIGS. 4A–7B and preferably includes all of the features of the straight ladder 21 described above in connection with FIGS. 1A–3A.

Figure 4A:
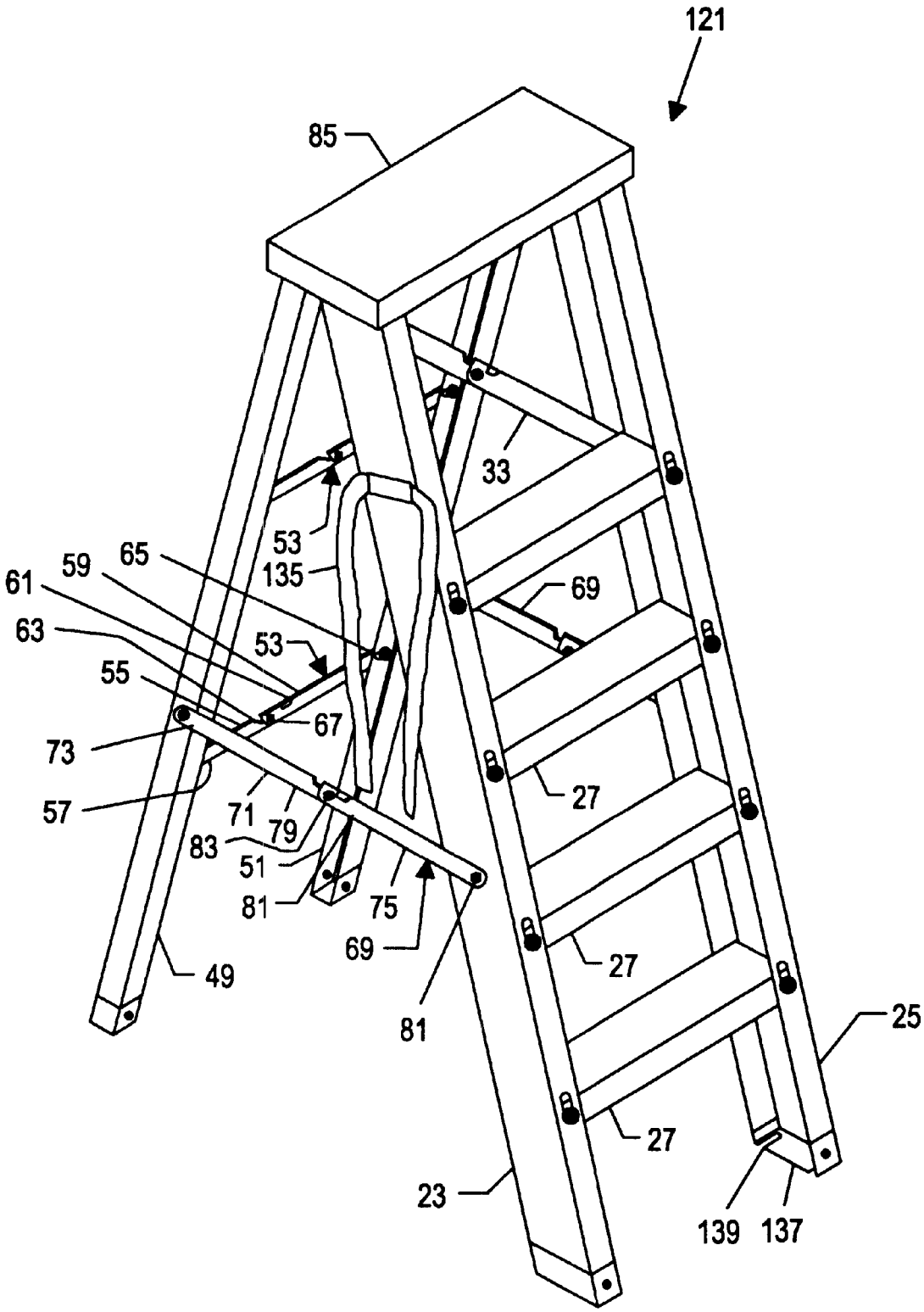
FIGS. 4A and 4B are perspective views of a foldable step ladder according to a second embodiment of the present invention showing the ladder in a use position and a closed position, respectively.
Figure 6:
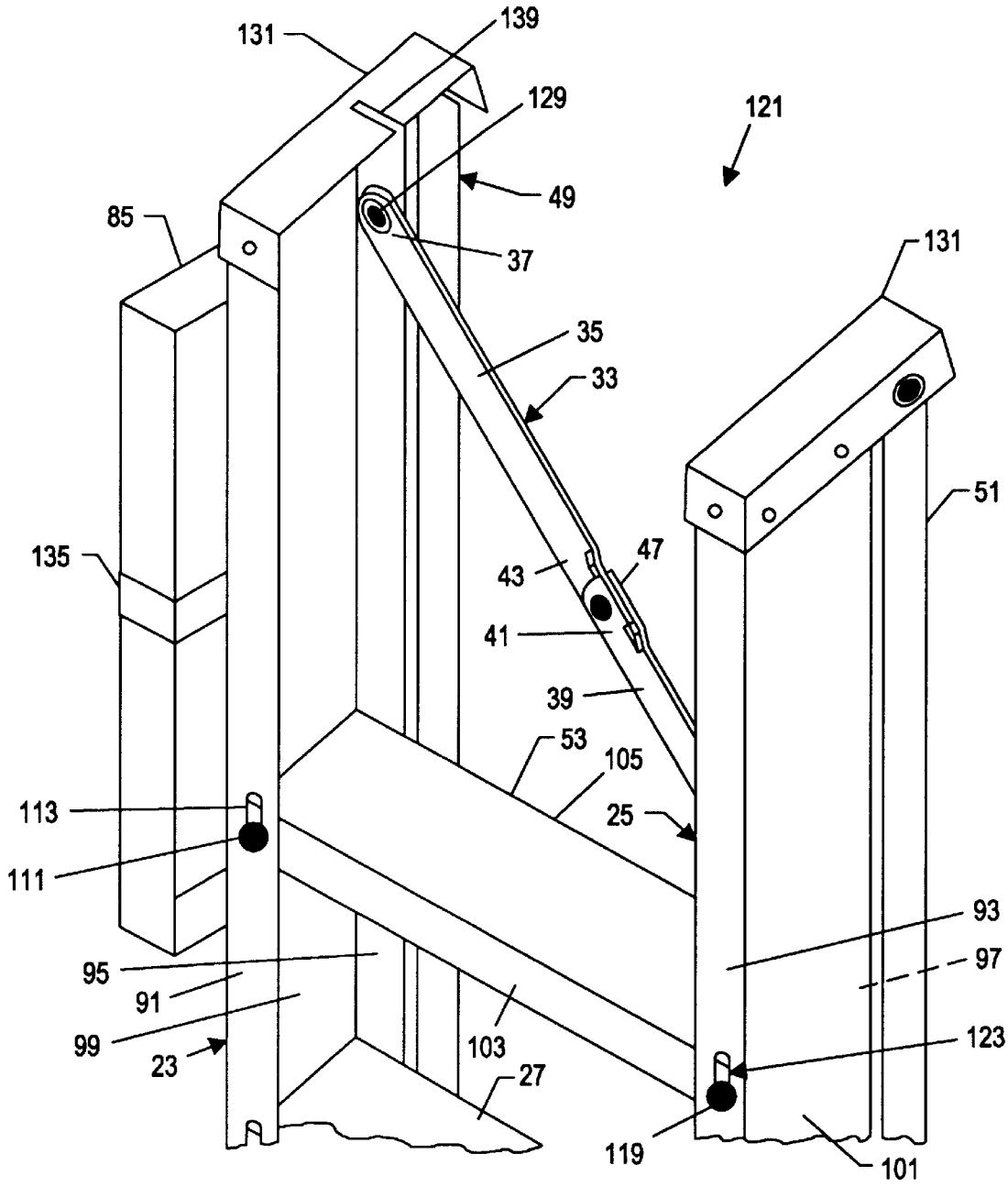
FIG. 6 is a perspective view of a portion of a foldable ladder according to the second embodiment of the present invention.

As seen in FIGS. 4A and 6, in the step ladder 121, the first side rail 23 is pivotally connected to a first back leg 49 and the second side rail 25 is pivotally connected to a second back leg 51. As seen in FIG. 4A, at least one leg locking member 53 having a first portion 55 pivotally attached at a first end 57 to the first back leg 49 and a second portion 59 pivotally attached at a first end 61 to a second end 63 of the first portion and a second end 65 pivotally attached to the second back leg 51 is provided. The first portion 55 and the second portion 59 are in a substantially parallel closed position when the rung 27 is in the closed position. The first portion 55 and the second portion 59 are pivotable relative to each other to a locking position in which the first portion and the second portion are substantially parallel to each other and substantially perpendicular to the first side rail 23 and the second side rail 25 when the rung is in the use position.

The leg locking member 53 includes a stop 67 disposed on at least one of the first portion 55 and the second portion 59 for preventing the first portion and the second portion from pivoting relative to each other beyond the locking position. The stop 67 is preferably any suitable one of the suitable stops usable as the stop 47.

Figure 4B:
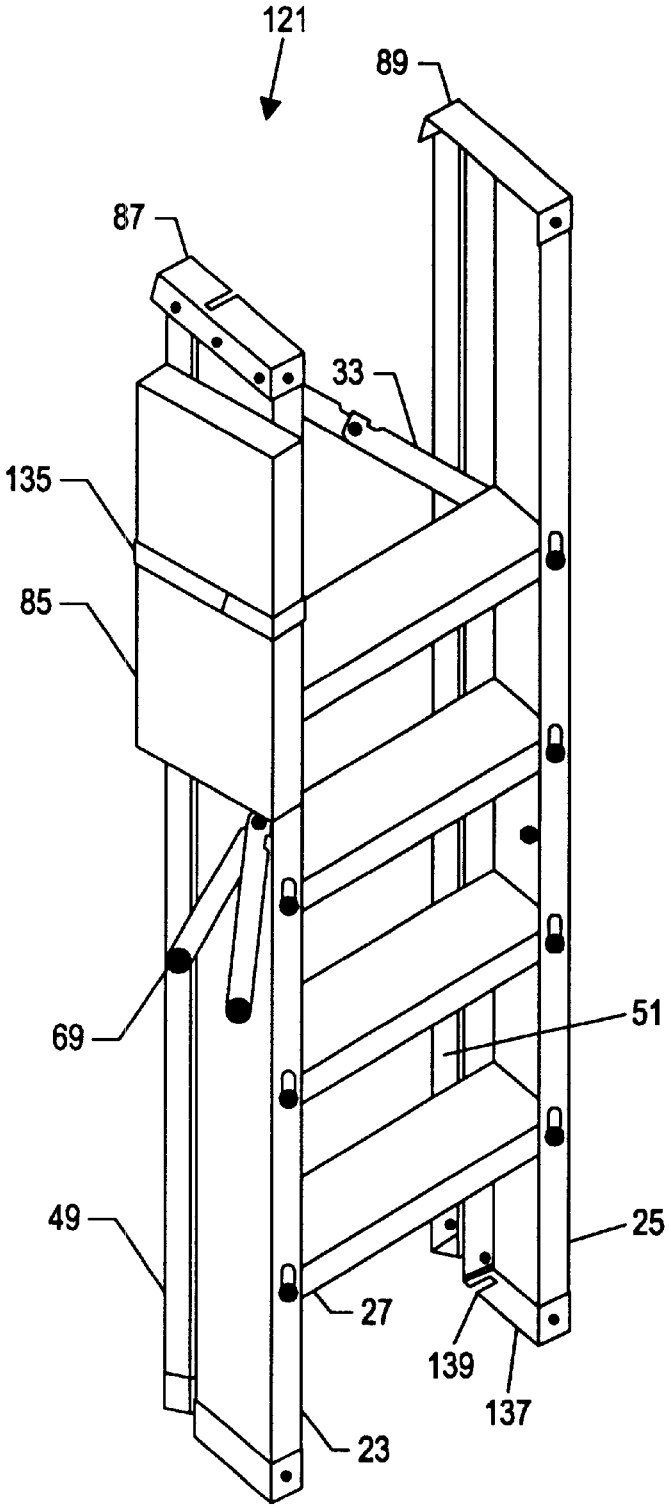
Figure 5A:
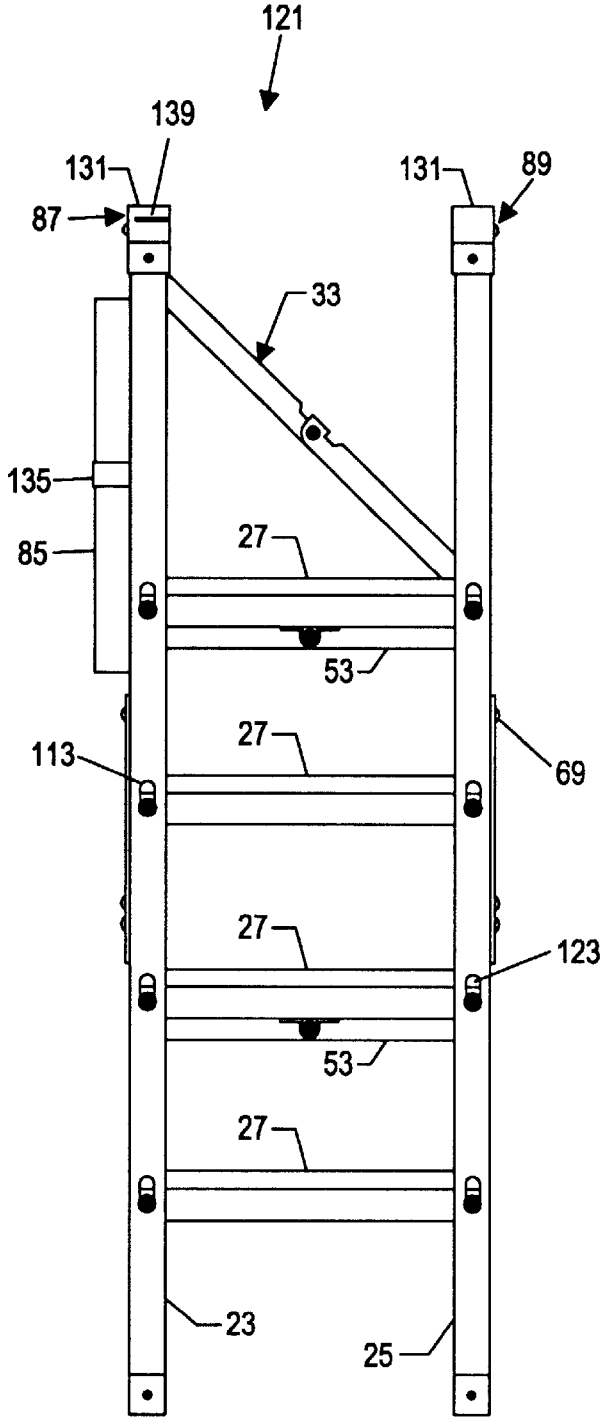
FIGS. 5A, 5B, and 5C are front views of a foldable ladder according to the second embodiment of the present invention showing the ladder in a use position, an intermediate position, and a closed position, respectively.
Figure 5B:
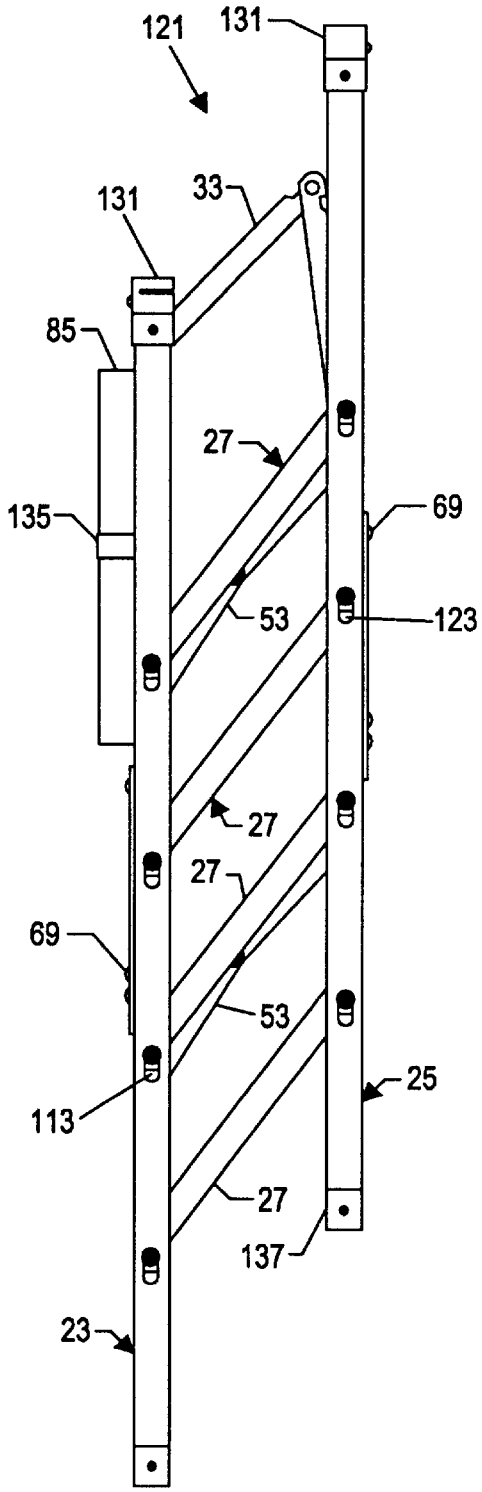
Figure 5C:
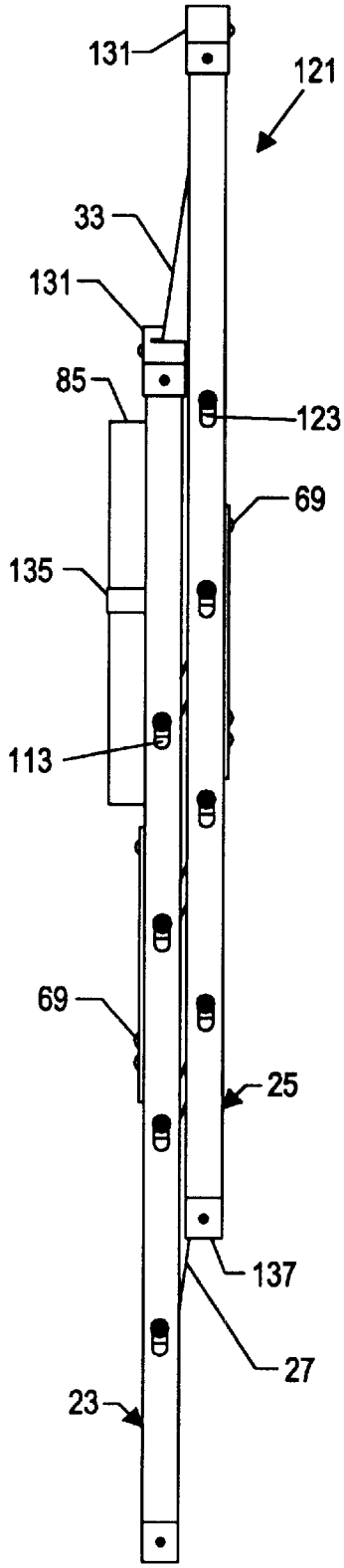

As seen in FIGS. 4A and 4B, the ladder 121 preferably also includes at least one side locking member 69 having, as seen in FIG. 4A, a first portion 71 pivotally attached at a first end 73 to the first back leg 49 and a second portion 75 pivotally attached at a first end 77 to a second end 79 of the first portion and a second end 81 pivotally attached to the first side rail 23. The first portion 71 and the second portion 75 are preferably in a substantially parallel closed position when the rung 27 is in the closed position. The first portion 71 and the second portion 75 are preferably pivotable relative to each other to a locking position in which the first portion and the second portion are substantially parallel to each other when the rung 27 is in the use position.

The side locking member 69 includes a stop 83 disposed on at least one of the first portion 71 and the second portion 75 for preventing the first portion and the second portion from pivoting relative to each other beyond the locking position. The stop 83 is preferably any suitable one of the suitable stops usable as the stop 47.

The ladder 121 preferably also includes a top shelf 85 adapted to be removably disposed over and extend between top ends 87 and 89 of the first side rail 23 and the second side rail 25 when the rung 27 is in the use position. The top shelf 85 is preferably provided with a recessed area for receiving the top ends 87 and 89 and preferably restrains the ladder so that the rung 27 will not be caused to move to the closed position when the top ends are disposed in the recess.

Figure 7A:
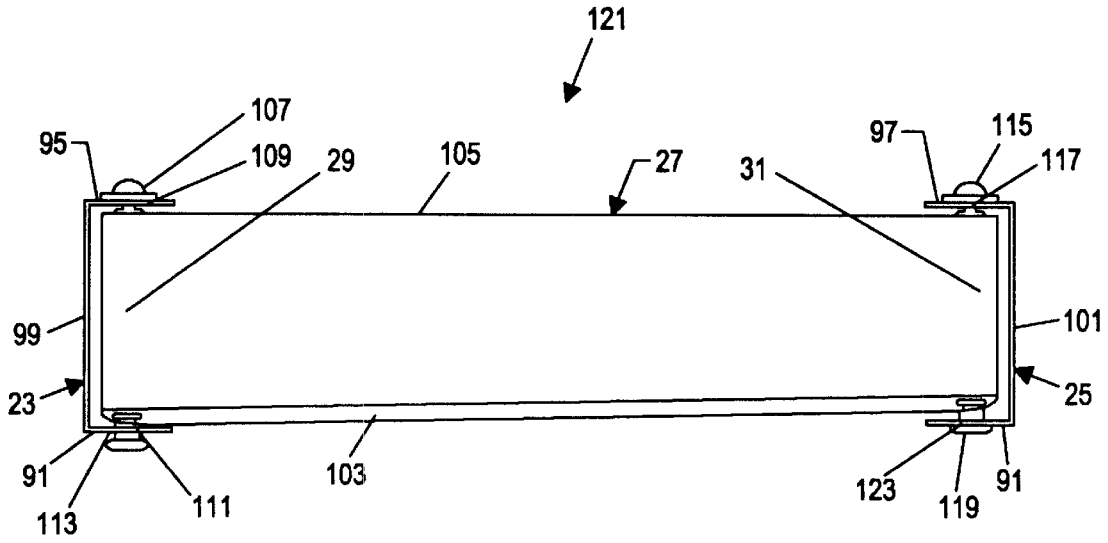
FIG. 7A is a top view of a foldable ladder according to the second embodiment of the present invention.
Figure 7B:
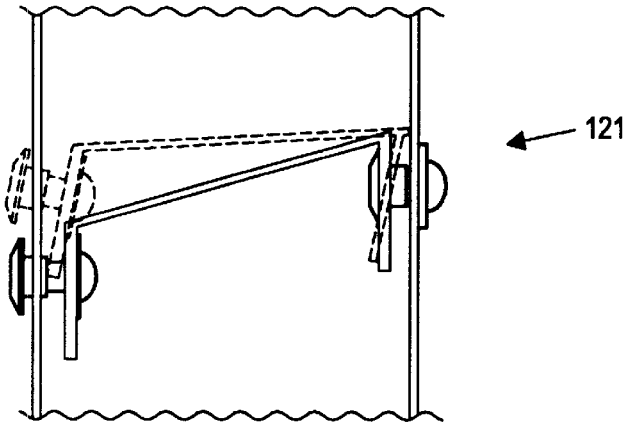
FIG. 7B is a side, partially cross-sectional view of a portion of a foldable ladder according to an embodiment of the present invention.

As seen in FIGS. 6, 7A, and 7B, the first side rail 23 and the second side rail 25 are each preferably U-shaped and open toward each other. As seen in FIG. 7A, each of the first side rail 23 and the second side rail 25 includes a front leg 91, 93, respectively and a rear leg 95, 97, respectively, connected by a web 99, 101, respectively. The rung 27 has a front side 103 and a rear side 105. The first end portion 29 of the rung 27 is pivotally attached to the first side rail 23 by a first rear pin 107 extending from the rear side 105 of the rung and through a first hole 109 in the rear leg 95 of the first side rail and by a first front pin 111 extending from the front side 103 of the rung and through a first longitudinal slot 113 (FIG. 6) in the front leg 91 of the first side rail. The second end portion 31 of the rung 27 is pivotally attached to the second side rail 25 by a second rear pin 115 extending from the rear side 105 of the rung and through a second hole 117 in the rear leg 97 of the second side rail and by a second front pin 119 extending from the front side 103 of the rung and through a second longitudinal slot 123 (FIG. 6) in the front leg 93 of the second side rail 25.

As seen in FIG. 7B, the rung 27 is pivotable about pivot points on the first and second rear pins 107 and 115 relative to the first side rail 23 and the second side rail 25 about an axis parallel to an axis of the rung. The rung 27 is preferably pivotable about this axis through a range of motion wherein, when the rung is in the use position, the first front pin 111 and the second front pin 119 are adapted to be disposed at bottoms of the first longitudinal slot 113 and the second longitudinal slot 123, respectively. When the rung 27 is in the closed position, the first front pin 111 and the second front pin 119 are preferably disposed at tops of the first longitudinal slot 113 and the second longitudinal slot 123, respectively. The tops of the first longitudinal slot 113 and the second longitudinal slot 123 are preferably disposed at substantially the same heights on the first side rail 23 and the second side rail 25 as the first hole 109 and the second hole 117, respectively.

Preferably, when the rung 27 is in the use position and the ladder 21 is upright, gravity causes the rung to pivot so that the first front pin 111 and the second front pin 119 are disposed at bottoms of the first longitudinal slot 113 and the second longitudinal slot 123, respectively. Further, when the first front pin 111 and the second front pin 119 are disposed at bottoms of the first longitudinal slot 113 and the second longitudinal slot 123, respectively, the first front pin and the second front pin are disposed vertically below the first rear pin 107 and the second rear pin 115 on the first side rail 23 and the second side rail 25. This slight offset preferably results in interference between the rung 27 and the first side rail 23 and the second side rail 25, such that pivoting of the rung from the use position is restrained. In addition to being used in step ladders, the rung 27 that is pivotable about an axis parallel to a longitudinal axis of the rung may be used in other types of ladders, such as straight ladders, if desired or necessary.

Figure 3A:
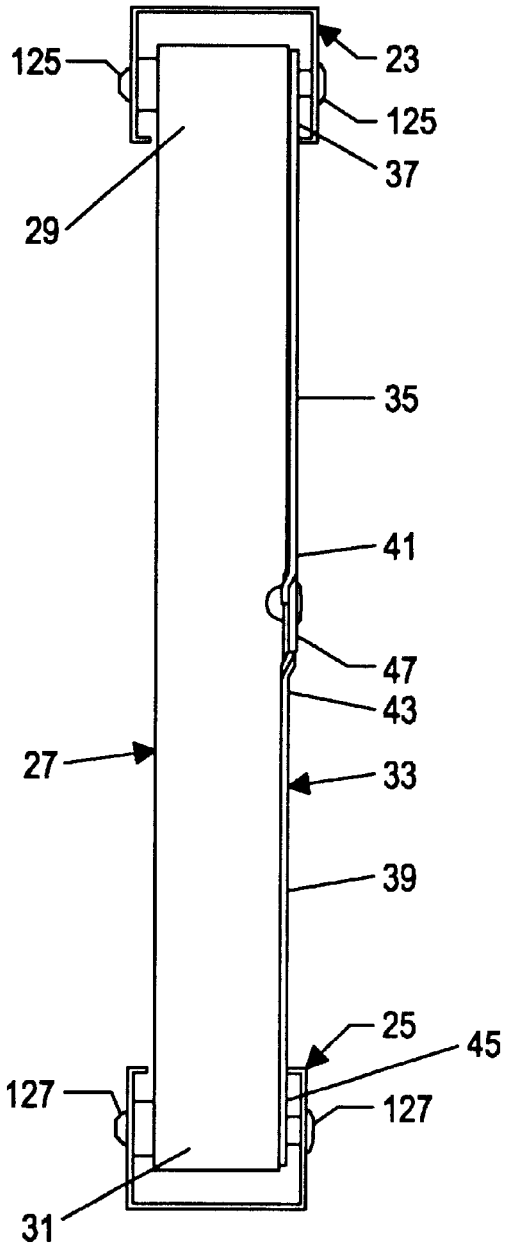
FIG. 3A is a top view of a foldable ladder according to the first embodiment of the present invention.

An alternative form of arrangement for the rung 27 is shown in FIGS. 1A–3A. Preferably, the first side rail 23 and the second side rail 25 are each U-shaped and open toward each other. The first end portion 29 of the rung 27 is pivotally pinned between the front leg 91 and the rear leg 95 of the first side rail 23 and the second end portion 31 is pivotally pinned between front leg 93 and the rear leg 97 of the of the second side rail 25. The rung 27 may be any suitable shape, such as U-shaped, circular in cross-section, or square or rectangular in cross-section. Preferably, the first end portion 29 of the rung 27 is pivotally pinned between the front leg 91 and the rear leg 95 of the first side rail 23 by a first pin 125 and the second end portion 31 is pivotally pinned between front leg 93 and the rear leg 97 of the of the second side rail 25 by a second pin 127. Preferably, the first end 37 of the first portion 35 of the diagonal locking member 33 is pivotally attached to the first side rail 23 by the first pin 125 and the second end 45 of the second portion 39 of the diagonal locking member is pivotally attached to the second side rail 25 by a third pin 129 disposed above the second pin 127 as seen in FIGS. 2 and 3A (FIG. 3A does not show the third pin 129 for the sake of clarity) or, as seen in FIGS. 1B–1C, the diagonal locking member 33 could be disposed diagonally so that the third pin 129 is disposed above the first pin 125 and the rung 27 and the second end 45 of the second portion 39 of the diagonal locking member could both be pinned to the second rail by the second pin 127.

Figure 3B:
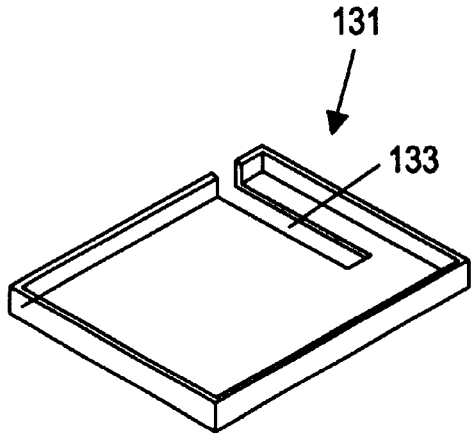
FIG. 3B is a perspective view of a slotted cap according to an embodiment of the present invention adapted for use with a foldable ladder according to the present invention.

As seen, for example, in FIGS. 3B and 6, an end cap 131 of the side rail having the vertically higher end of the diagonal locking member 33 pivotally attached thereto may be provided with a slot 133. The slot 133 facilitates folding of the diagonal locking member 33 when the rung 27 is moved to the closed position, e.g., as seen in FIGS. 1A–1C and FIGS. 5A–5C where, otherwise the end cap might interfere with the diagonal locking member 33 pivoting to a position in which the first and second portions 35 and 39 of the diagonal locking member are substantially parallel to the first and second side rails 23 and 25.

As seen in FIGS. 4A and 4B, a bottom end cap 137 for a bottom end of at least one of the first and second side rails 23 and 25 may be provided with slots 139 for receiving legs of the rung 27 when the rung is a U-shaped member. The slots 139 facilitate folding such a rung 27 to the closed position in which it is substantially parallel to the first and second side rails 23 and 25. If a rung 27 having a cross-sectional shape other than U-shaped, e.g., circular, rectangular, square, etc. is used, a suitable slot for receiving the rung can be formed in the bottom end cap.

As seen in FIGS. 4A and 4B, a cord or strap 135 is preferably fastened to the ladder 21 at a suitable location so that, when the ladder is folded so that the rung 27 is in the closed position, the cord can be used to tie up the ladder and keep it folded. When the ladder has a removable shelf 85, the cord 135 may also be used to secure the shelf 85 relative to the ladder.

The foregoing embodiments all show the diagonal locking member 33 at a top end of the ladder 21. While this is presently believed to be a convenient location for the diagonal locking member 33, it will be appreciated that the diagonal locking member can be located at any desired, convenient location on the ladder. In addition, while the illustrated embodiments show only a single diagonal locking member 33, the ladder may have a plurality of diagonal locking members, if desired or necessary.

While this invention has been illustrated and described in accordance with a preferred embodiment, it is recognized that variations and changes may be made therein without departing from the invention as set forth in the claims.

What is claimed is:

1. A folding ladder, comprising:

a first side rail and a second side rail, at least one rung having a first end portion and a second end portion, the first end portion being pivotally attached to the first side rail and the second end portion being pivotally attached to the second side rail, the rung being pivotable relative to the first side rail and the second side rail between a use position in which the rung is substantially perpendicular to each of the first side rail and the second side rail and a closed position in which the rung is substantially parallel to each of the first side rail and the second side rail; and at least one diagonal locking member having a first portion pivotally attached at a first end to the first side rail and a second portion pivotally attached at a first end to a second end of the first portion, the first end of the second portion and the second end of the first portion defining a central pivot point, and a second end pivotally attached to the second side rail, the first end of the first portion and the second end of the second portion defining first and second end pivot points, respectively, the first portion and the second portion being in a substantially parallel closed position with the central pivot point being disposed above the first and second end pivot points when the rung is in the closed position and being pivotable relative to each other to a locking position in which the first portion and the second portion are substantially parallel to each other and non-perpendicular to the first side rail and the second side rail and the central pivot point is disposed below one of the first and second end pivot points and above the other one of the first and second end pivot points when the rung is in the use position, the locking member including a stop disposed on at least one of the first portion and the second portion for preventing the first portion and the second portion from pivoting relative to each other beyond the locking position.

2. The folding ladder according to claim 1, wherein the ladder includes a plurality of rungs.

3. The folding ladder according to claim 1, wherein the ladder is a straight ladder.

4. The folding ladder according to claim 1, wherein the ladder is a step ladder.

5. The folding ladder according to claim 4, wherein the first side rail is pivotally connected to a first back leg and the second side rail is pivotally connected to a second back leg, and wherein at least one leg locking member having a first portion pivotally attached at a first end to the first back leg and a second portion pivotally attached at a first end to a second end of the first portion and a second end pivotally attached to the second back leg, the first portion and the second portion being in a substantially parallel closed position when the rung is in the closed position and being pivotable relative to each other to a locking position in which the first portion and the second portion are substantially parallel to each other and substantially perpendicular to the first side rail and the second side rail when the rung is in the use position, the leg locking member including a stop disposed on at least one of the first portion and the second portion for preventing the first portion and the second portion from pivoting relative to each other beyond the locking position.

6. The folding ladder according to claim 5, wherein at least one side locking member having a first portion pivotally attached at a first end to the first back leg and a second portion pivotally attached at a first end to a second end of the first portion and a second end pivotally attached to the first side rail, the first portion and the second portion being in a substantially parallel closed position when the rung is in the closed position and being pivotable relative to each other to a locking position in which the first portion and the second portion are substantially parallel to each other when the rung is in the use position, the side locking member including a stop disposed on at least one of the first portion and the second portion for preventing the first portion and the second portion from pivoting relative to each other beyond the locking position.

7. The folding ladder according to claim 4, further comprising a top shelf adapted to be removably disposed over and extend between top ends of the first side rail and the second side rail when the rung is in the use position.

8. The folding ladder according to claim 1, wherein the first side rail and the second side rail are each U-shaped and open toward each other, each of the first side rail and the second side rail including a front leg and a rear leg connected by a web, and wherein the first end portion of the rung is pivotally pinned between the front leg and the rear leg of the first side rail and the second end portion is pivotally pinned between front leg and the rear leg of the second side rail.

9. The folding ladder according to claim 8, wherein the first end portion of the rung is pivotally pinned between the front leg and the rear leg of the first side rail by a first pin and the second end portion is pivotally pinned between front leg and the rear leg of the of the second side rail by a second pin, and the first end of the first portion of the diagonal locking member is pivotally attached to the first side rail by the first pin.

10. A folding ladder, comprising:

a first side rail and a second side rail, at least one rung having a first end portion and a second end portion, the first end portion being pivotally attached to the first side rail and the second end portion being pivotally attached to the second side rail, the rung being pivotable relative to the first side rail and the second side rail between a use position in which the rung is substantially perpendicular to each of the first side rail and the second side rail and a closed position in which the rung is substantially parallel to each of the first side rail and the second side rail; and at least one diagonal locking member having a first portion pivotally attached at a first end to the first side rail and a second portion pivotally attached at a first end to a second end of the first portion and a second end pivotally attached to the second side rail, the first portion and the second portion being in a substantially parallel closed position when the rung is in the closed position and being pivotable relative to each other to a locking position in which the first portion and the second portion are substantially parallel to each other and non-perpendicular to the first side rail and the second side rail when the rung is in the use position, the locking member including a stop disposed on at least one of the first portion and the second portion for preventing the first portion and the second portion from pivoting relative to each other beyond the locking position, wherein the ladder is a step ladder and wherein the first side rail and the second side rail are each U-shaped and open toward each other, each of the first side rail and the second side rail including a front leg and a rear leg connected by a web, the rung has a front side and a rear side, the first end portion being pivotally attached to the first side rail by a first rear pin extending from the rear side of the rung and through a first hole in the rear leg of the first side rail and by a first front pin extending from the front side of the rung and through a first longitudinal slot in the front leg of the first side rail, and the second end portion being pivotally attached to the second side rail by a second rear pin extending from the rear side of the rung and through a second hole in the rear leg of the second side rail and by a second front pin extending from the front side of the rung and through a second longitudinal slot in the front leg of the second side rail.

11. The folding ladder according to claim 10, wherein the rung is pivotable about pivot points on the first and second rear pins relative to the first side rail and the second side rail about an axis parallel to an axis of the rung through a range of motion wherein, when the rung is in the use position, the first front pin and the second front pin are adapted to be disposed at bottoms of the first longitudinal slot and the second longitudinal slot, respectively, and, when the run is in the closed position, the first front pin and the second front pin are disposed at tops of the first longitudinal slot and the second longitudinal slot, respectively.

12. The folding ladder according to claim 11, wherein the tops of the first longitudinal slot and the second longitudinal slot are disposed at substantially the same heights on the first side rail and the second side rail as the first hole and the second hole, respectively.

13. The folding ladder according to claim 11, wherein when the rung is in the use position and the ladder is upright, gravity causes the rung to pivot so that the first front pin and the second front pin are disposed at bottoms of the first longitudinal slot and the second longitudinal slot, respectively.

14. The folding ladder according to claim 13, wherein, when the first front pin and the second front pin are disposed at bottoms of the first longitudinal slot and the second longitudinal slot, respectively, the first front pin and the second front pin are disposed vertically below the first rear pin and the second rear pin on the first side rail and the second side rail, respectively, such that pivoting of the rung from the use position is restrained.

15. A folding ladder, comprising:

a first side rail and a second side rail, at least one rung having a first end portion and a second end portion, the first end portion being pivotally attached to the first side rail and the second end portion being pivotally attached to the second side rail, the rung being pivotable relative to the first side rail and the second side rail between a use position in which the rung is substantially perpendicular to each of the first side rail and the second side rail and a closed position in which the rung is substantially parallel to each of the first side rail and the second side rail; and at least one diagonal locking member having a first portion pivotally attached at a first end to the first side rail and a second portion pivotally attached at a first end to a second end of the first portion and a second end pivotally attached to the second side rail, the first portion and the second portion being in a substantially parallel closed position when the rung is in the closed position and being pivotable relative to each other to a locking position in which the first portion and the second portion are substantially parallel to each other and non-perpendicular to the first side rail and the second side rail when the rung is in the use position, the locking member including a stop disposed on at least one of the first portion and the second portion for preventing the first portion and the second portion from pivoting relative to each other beyond the locking position, wherein the first side rail and the second side rail are each U-shaped and open toward each other, each of the first side rail and the second side rail including a front leg and a rear leg connected by a web, the rung has a front side and a rear side, the first end portion being pivotally attached to the first side rail by a first rear pin extending from the rear side of the rung and through a first hole in the rear leg of the first side rail and by a first front pin extending from the front side of the rung and through a first longitudinal slot in the front leg of the first side rail, and the second end portion being pivotally attached to the second side rail by a second rear pin extending from the rear side of the rung and through a second hole in the rear leg of the second side rail and by a second front pin extending from the front side of the rung and through a second longitudinal slot in the front leg of the second side rail.

16. The folding ladder according to claim 15, wherein the rung is pivotable about pivot points on the first and second rear pins relative to the first side rail and the second side rail about an axis parallel to an axis of the rung through a range of motion wherein, when the rung is in the use position, the first front pin and the second front pin are adapted to be disposed at bottoms of the first longitudinal slot and the second longitudinal slot, respectively, and, when the run is in the closed position, the first front pin and the second front pin are disposed at tops of the first longitudinal slot and the second longitudinal slot, respectively.

17. The folding ladder according to claim 16, wherein the tops of the first longitudinal slot and the second longitudinal slot are disposed at substantially the same heights on the first side rail and the second side rail as the first hole and the second hole, respectively.

18. The folding ladder according to claim 15, wherein when the rung is in the use position and the ladder is upright, gravity causes the rung to pivot so that the first front pin and the second front pin are disposed at bottoms of the first longitudinal slot and the second longitudinal slot, respectively.

19. The folding ladder according to claim 18, wherein, when the first front pin and the second front pin are disposed at bottoms of the first longitudinal slot and the second longitudinal slot, respectively, the first front pin and the second front pin are disposed vertically below the first rear pin and the second rear pin on the first side rail and the second side rail, respectively, such that pivoting of the rung from the use position is restrained.

* * * * *